US008689806B2

(12) United States Patent
Tufts et al.

(10) Patent No.: US 8,689,806 B2
(45) Date of Patent: Apr. 8, 2014

(54) ILLUMINATED NAILS

(76) Inventors: Paul Randal Tufts, Eagan, MN (US); Donald Richard Swanson, Elgin, MN (US)

( * ) Notice: Subject to any disclaimer, the term of this patent is extended or adjusted under 35 U.S.C. 154(b) by 2020 days.

(21) Appl. No.: 11/350,175

(22) Filed: Feb. 8, 2006

(65) Prior Publication Data

US 2007/0181142 A1 Aug. 9, 2007

(51) Int. Cl.
*A45D 29/00* (2006.01)

(52) U.S. Cl.
USPC ..... 132/73

(58) Field of Classification Search
USPC ..... 132/73, 73.5; 63/1.13; 362/84; 313/506; 428/457
See application file for complete search history.

(56) References Cited

U.S. PATENT DOCUMENTS

| | | | | |
|---|---|---|---|---|
| 4,513,692 | A | 4/1985 | Kuhnsman et al. | |
| D292,616 | S | 11/1987 | Sexton | |
| 4,751,935 | A | 6/1988 | Mast et al. | |
| D303,161 | S | 8/1989 | Tomkins | |
| 4,887,552 | A | 12/1989 | Hayden | |
| 4,920,991 | A | 5/1990 | Shibahashi et al. | |
| 5,036,442 | A | 7/1991 | Brown | |
| 5,226,718 | A | 7/1993 | Lin | |
| 5,351,704 | A | 10/1994 | Hunnicutt, Jr. et al. | |
| 5,370,390 | A | 12/1994 | Swanson | |
| 5,429,075 | A | 7/1995 | Passarella et al. | |
| 5,429,140 | A | 7/1995 | Burdea et al. | |
| 5,558,044 | A | 9/1996 | Nasser, Jr. et al. | |
| 5,567,037 | A | 10/1996 | Ferber | |
| 5,607,226 | A | 3/1997 | Toth et al. | |
| 5,690,412 | A | 11/1997 | Sheldon | |
| D413,183 | S * | 8/1999 | Drake | D28/56 |
| 6,106,130 | A | 8/2000 | Harding | |
| 6,236,037 | B1 | 5/2001 | Asada et al. | |
| 6,360,615 | B1 | 3/2002 | Smela | |
| 6,499,857 | B1 | 12/2002 | Lumley | |
| 6,631,723 | B1 | 10/2003 | Mullin | |
| 6,637,906 | B2 * | 10/2003 | Knoerzer et al. | 362/84 |
| 6,832,842 | B2 | 12/2004 | Sullivan | |
| 6,901,934 | B1 | 6/2005 | Tran | |
| 6,908,206 | B1 | 6/2005 | Pinciaro | |
| 2001/0025917 | A1 | 10/2001 | Asada et al. | |
| 2002/0112734 | A1 * | 8/2002 | Rambeau et al. | 132/73 |
| 2004/0031287 | A1 * | 2/2004 | Leason et al. | 63/1.13 |
| 2004/0214020 | A1 * | 10/2004 | Lecomte | 428/457 |
| 2005/0067952 | A1 * | 3/2005 | Fechter et al. | 313/506 |

FOREIGN PATENT DOCUMENTS

| | | |
|---|---|---|
| JP | 2001-275740 | 10/2001 |
| JP | 2004-344628 | 12/2004 |

OTHER PUBLICATIONS

"Ultra-compact, slim EL driver that adds a new dimension to displays", Surface Mountable EL Drive Unit EL Driver Module, pp. 152-156.
"Surface Mountable Illuminated Switch LS20 Series", LS20, pp. 68-69.
"Surface Mountable Switch LS35 Series", LS35, pp. 63.

(Continued)

*Primary Examiner* — Robyn Doan
(74) *Attorney, Agent, or Firm* — Hamre, Schumann, Mueller & Larson, P.C.

(57) ABSTRACT

An artificial nail has a nail platform, an electroluminescence material connected to the nail platform, and an electric circuit electrically connected to the electroluminescence material. The electroluminescence material is preferably an electroluminescent film or other material that becomes luminous upon application of alternating current. When an electroluminescent film is used, the electric circuit preferably includes a driver module that provides sufficient alternating current to drive the electroluminescent film.

16 Claims, 6 Drawing Sheets

(56) References Cited

OTHER PUBLICATIONS

"Durel DFLX Flexible Electroluminescent Lamp" Data Sheet, Rogers Corporation, pp. 1-2, 2004.
"FlatLite Sales Bulletin—Design and Application Guidelines", E-Lite Technologies, Inc., 2 pages.
"D388A Combination EL Lamp and White LED Driver", Durel Corporation, LIT-19044, Rev. A03, pp. 1-13, 2003.
"Durel Backlight IC Driver Product Selector Guide", Rogers Corporation, LIT-B9002, Rev. A16, pp. 1-3, 1998.
"NC7SP74 TinyLogic ULP D-Type Flip-Flop with Preset and Clear", Fairchild Semiconductor, DS500820, pp. 1-12, Jan. 2003.
PCT Written Opinion of the International Searching Authority for corresponding International Application No. PCT/US2007/061457.
PCT International Search Report for corresponding International Application No. PCT/US2007/061457.

* cited by examiner

ILLUMINATED NAILS

TECHNICAL FIELD

The invention relates to an artificial nail, for example, a fingernail or a toenail, which has electroluminescence material that becomes luminous upon application of electrical energy.

BACKGROUND OF THE INVENTION

Artificial nails are known cosmetic items that are available for home use or professional application at salons, boutiques and drug stores. Artificial nails are of assorted material, for example a plastic material. They are first adhered to an existing natural nail and then nail polish can be applied. To add a sense of style, artificial nails, like natural nails, may be embellished by not only nail polish, but also various other embellishments. These embellishments include painting designs or highlights on the nail and affixing decals to the nail. In addition, U.S. Pat. No. 6,631,723 ('723 Patent) discloses attaching a three dimensional feature that has sound and light emitting devices to an artificial fingernail. The '723 Patent describes an artificial nail that "may include a power source and a light emitter to emit light from a portion of the three dimensional feature." But the '723 Patent does not describe attaching to the artificial nail an electroluminescence material that becomes luminous upon application of electrical energy. Moreover, the '723 Patent does not disclose or teach an illumination element attached to the top or bottom surface of the artificial nail.

SUMMARY OF THE INVENTION

This disclosure relates to an artificial nail including electroluminescence material. The electroluminescence material can be any suitable electroluminescence material that becomes luminous upon application of electrical energy, for example a film, paint, polish, pigment, etc.

In one embodiment, an artificial nail has a nail platform, and electroluminescence material connected to the nail platform.

In another embodiment, a nail decorating product has a nail platform, an electroluminescence material connected to the nail platform, and an electric circuit that is electrically connected to the electroluminescence material. The electric circuit has a driver module, a power source, and a switch that controls the flow of electricity to the electroluminescence material.

In still another embodiment, an artificial nail has a nail platform with electroluminescence material that becomes luminous upon application of electrical energy.

In still another embodiment, an artificial nail has a nail platform with a top surface, a bottom surface, and a thickness defined between the top surface and the bottom surface, and an illumination element is secured to at least one of the top surface and the bottom surface.

DETAILED DESCRIPTION

An artificial nail described herein includes an embellishment in the form of an illumination element, for example an electroluminescence material. Electroluminescence is the emission of cold light by certain substances when acted upon by an alternating electric field. The electroluminescence material can be any suitable electroluminescence material, for example a film, paint, polish, pigment, etc., that becomes luminous upon application of AC power. The electroluminescence material is preferably a film that becomes luminous upon application of AC power. The film can be any film-like material that becomes luminous upon application of electrical energy, for example electroluminescent film (hereinafter "EL film"). For convenience, the electroluminescence material will hereinafter be described as being an EL film, although it is to be realized that other electroluminescence materials could be utilized.

The artificial nail can include an electric circuit connected to the EL film. The electric circuit can include a driver module that provides sufficient and suitable power to drive the EL film. In certain embodiments, the electric circuit can include a space for inserting a power source that provides electrical power. The power source, for example a battery, can be inserted by the nail wearer. Alternatively, the power source can be integrally formed with the artificial nail, instead of being inserted by a consumer, in which case the electric circuit will also preferably include a suitable switch to control the flow of power to the EL film.

The artificial nail can be configured for attachment to an existing fingernail or to an existing toenail. For convenience in describing the inventive concepts, the artificial nail will be described as being attached to a fingernail.

Figure 1:
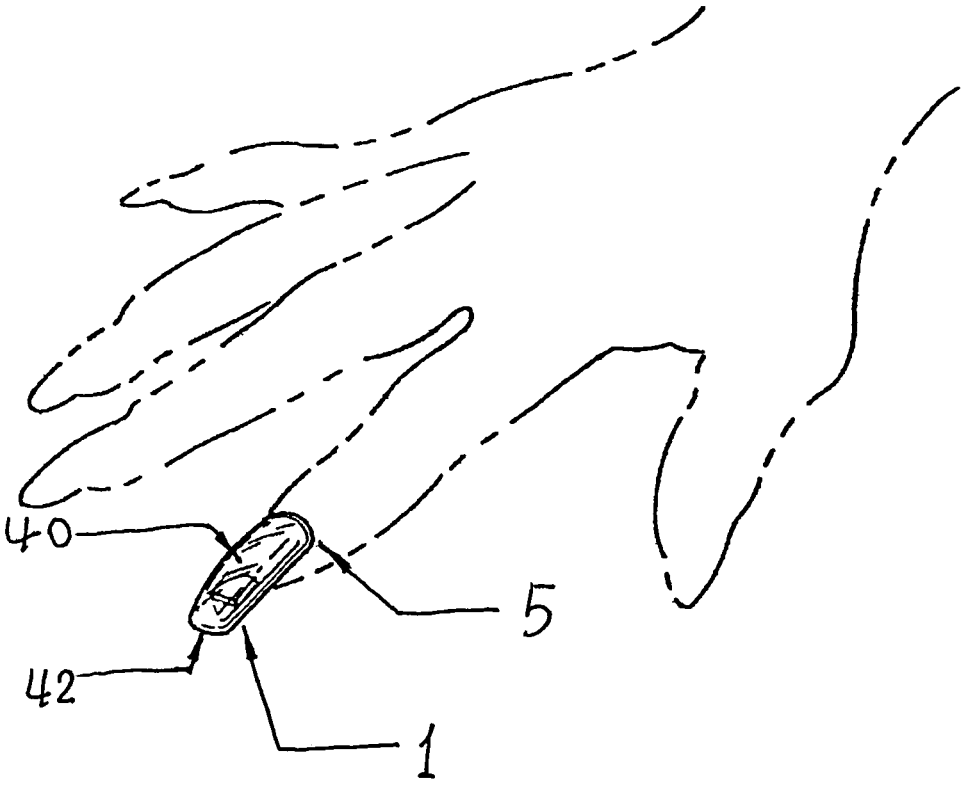
FIG. 1 is a view of an artificial nail applied to a fingernail.

The terms "above," "on", "under", "top", and "bottom" used in the description and/or claims are in reference to the relative positions of the artificial nail in use when oriented as in FIG. 1.

Referring to FIG. 1, an artificial nail 1 is shown as applied to a fingernail 5. The artificial nail 1 is generally elongated and curved in cross-section (see FIG. 2) to generally match the curvature of a human fingernail. The artificial nail 1 may be attached to the fingernail 5 using a conventional adhesive commonly used for attaching artificial fingernails to human fingernails. The adhesive may be applied by the user or be applied to the artificial nail during manufacture. In the later case, the adhesive may include a backing that must be removed before the artificial nail 1 is applied to the fingernail 5. The nail 1 generally has a top surface 40 and a bottom surface 42 (not visible in FIG. 1), with a portion of the bottom surface being fastened to the existing fingernail 5.

Figure 2:
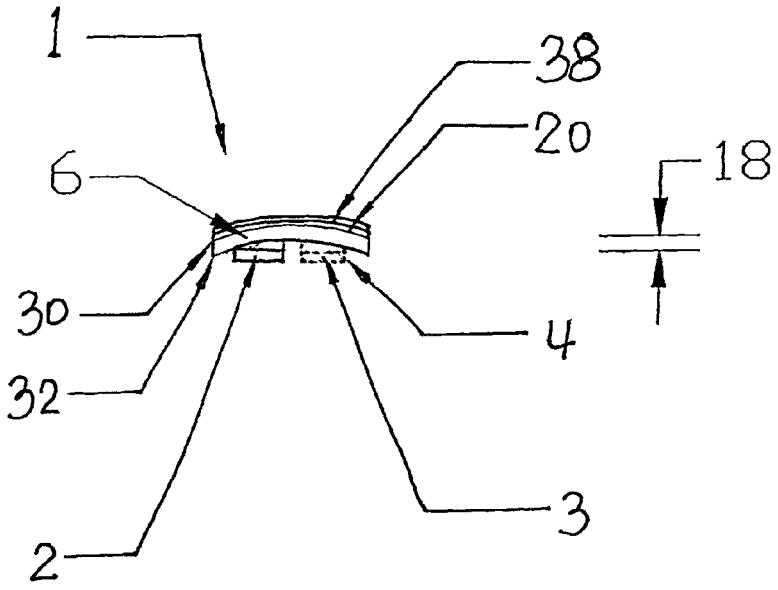
FIG. 2 is a cross-sectional view of an artificial nail taken along line 2-2 in FIG. 3, where the nail includes an electroluminescent film with a protective layer on a top surface of a nail platform.
Figure 3:
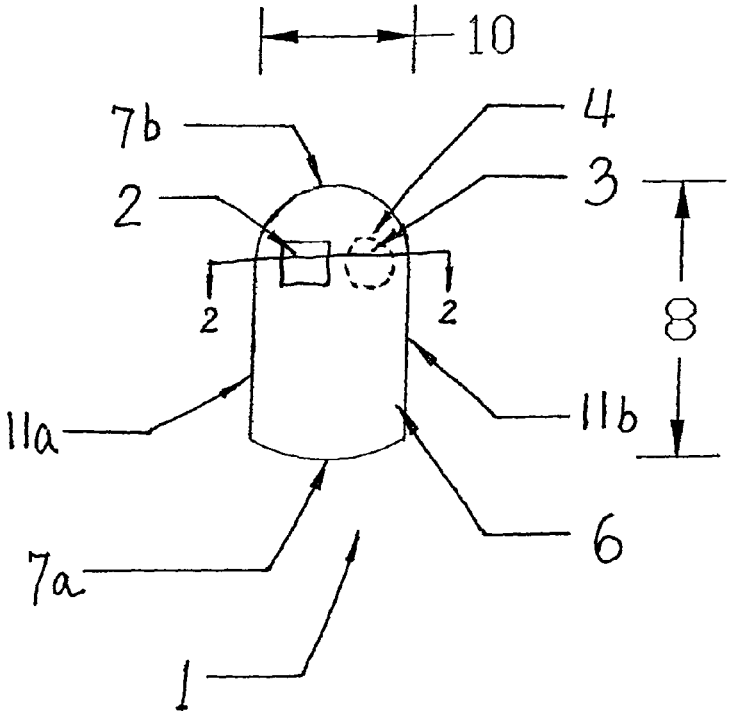
FIG. 3 is a bottom view of the nail in FIG. 2.

Referring to FIGS. 2 and 3, the artificial nail 1 includes a nail platform 6, an electroluminescence material in the form of an EL film 20, an optional protective layer 38 overlying the EL film 20, and an electric circuit 34 (shown in FIG. 6) including a driver module 2.

The nail platform 6 can be made of any substance commonly used for making artificial nails, for example, acrylic, plastic, porcelain, etc. The platform 6 has a first major surface in the form of a top surface 30, a second major surface in the form of a bottom surface 32 generally opposed to the top surface 30, and a thickness 18 defined between the top surface 30 and the bottom surface 32. The nail platform 6 also has a length 8 extending from a base end 7*a* to a tip end 7*b* and a width 10 measured between left and right side edges 11*a*, 11*b* respectively. The side edges 11*a*, 11*b* are illustrated as being generally parallel to each other, while the base end 7*a* and tip end 7*b* are illustrated as being generally arcuate and extending from the side edges 7*a*, 7*b*. The length 8 of the nail platform 6 can be approximately as long as an existing nail such that it extends minimally beyond the end of a fingertip when attached. Alternatively, the nail platform 6 may be longer and extend well beyond the wearer's fingertip and existing fingernail. Other configurations of the nail platform 6 are possible The EL film 20 is a thin, flat, uniform light source that is connected to the nail platform 6. For example the film 20 can have a thickness of about 0.1 mm. An EL film contains phosphor particles which light up when sufficient electrical energy in the form an alternating current is applied. EL films have uniform radiance over their surface, which appears equally bright from all viewpoints of 180° on a flat surface. EL films are available in a variety of colors. An example of a suitable EL film 20 is a DFLX™ Lamp available from Rogers Corporation of Rogers, Conn., United States.

A light emitting diode that has stronger brightness can be used in combination with the EL film 20 to create a variety of light effects. For example, a light pattern can be provided whereby the light emitting diode provides a bright light, for example a red light, and the EL film provides, for example, a green background. Or the light emitting diode can be made to flash, while the EL film, as the background, does not, or vice versa. Or both the light emitting diode and the EL film flash on various cycles. Alternatively, the light emitting diode can also be used to show whether the electric circuit is connected or not.

In one embodiment, the EL film 20 is connected to the top surface 30 of the nail platform 6 through an adhesive. The adhesive may be any adhesive that allows for secure attachment to the nail platform 6. The EL film 20 can cover the entire top surface 30, or alternatively, merely a portion of the top surface 30.

Figure 6:
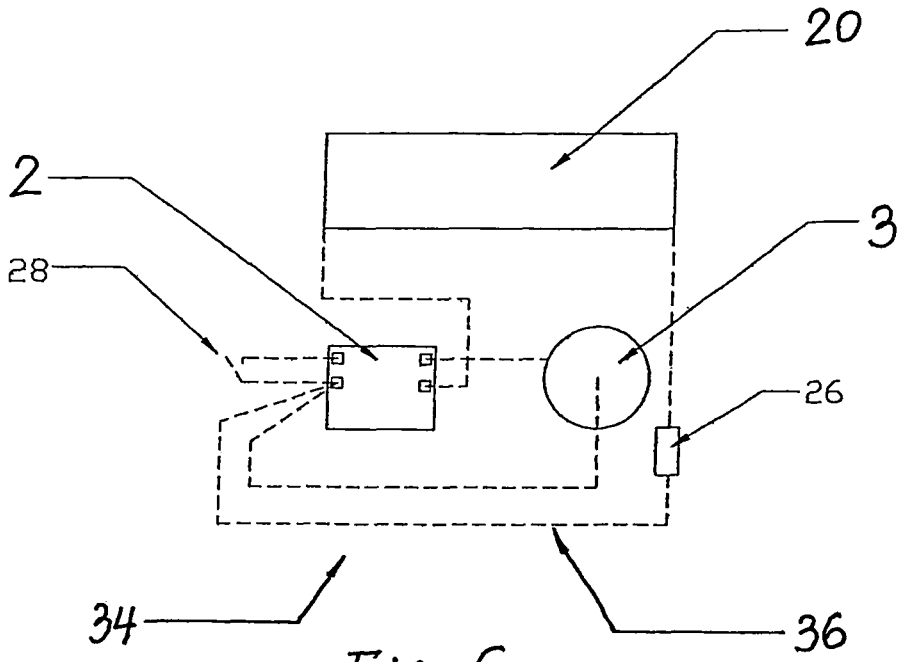
FIG. 6 is a schematically simplified representation of an exemplary embodiment of an electric circuit that can electrically connect to the electroluminescent film.

With reference to FIGS. 2-3 and 6, the electric circuit 34 is electrically connected to the EL film 20. The circuit 34 includes at least the driver module 2, an optional power source 3, an optional switch 28, an optional resistor 26, and electric connectors 36 for connecting the components of the circuit to each other and to the EL film 20.

The driver module 2 is a small-and-thin-sized package that is used to increase driving voltage or amplify current in order to provide the required working current for the EL film 20. For example, the driver module 2 can take 3 volt DC power from the power source 3 and change it to 220 volt AC power to drive the EL film 20. An example of a suitable driver module 2 is an ELD-4410 EL driver available from CITIZEN Electronics Co., Ltd. of Yamanashi, Japan.

In one embodiment, the electric circuit 34 also has a holder 4 for holding a power source 3, for example a battery. In this embodiment, the end user of the artificial nail inserts a battery in the battery holder 4 prior to use of the artificial nail. In this way, insertion and removal of the battery can function like a switch to control power flow to the EL film. If desired, a switch, such as one of the switches to be later described, can also be used in the circuit 34.

As an alternative to requiring the end user to insert a power source, the power source 3 can be pre-installed or integrally formed in the electric circuit 34 during manufacture of the artificial nail. The power source 3 can be a battery which may be configured to be replaceable, rechargeable, and/or disposable. An example of a suitable power source is a 3V Lithium PC Mount Coin Cell available from RENATA SA of Itingen, Switzerland.

When the power source 3 is pre-installed, or when the functionality is desired, the switch 28 can be included in the circuit 34. The switch 28 is used to control the flow of electricity to the EL film 20. The switch 28 can be a light emitting diode-type switch, illuminating switch, leaf-type switch, magnet switch, momentary switch, push on/push off, or other suitable switch. An example of a suitable switch useable in the circuit 34 is a Surface Mountable Illuminated Switch of LS 20 Series or LS 35 Series from CITIZEN Electronics Co., Ltd. of Yamanashi, Japan. Alternatively, instead of having a switch, the power source 3 can have an electric isolator that isolates the battery from the circuit, but that is removable by the end user to establish electrical connection.

If desired, the switch 28 can be made to turn on and off at periodic intervals, at random intervals, based on the user's movements, and/or based on a sensed environmental condition, such as noise, to cause flashing/strobing of the EL film. This flashing/strobing of the EL film enhances the visual appeal of the nail 1. Instead of turning the switch on and off, suitable components can be incorporated into the circuit 34 to interrupt current flow and achieve a similar effect to turning the switch on and off.

The switch 28 can be located at any suitable location on the nail 1. If the switch 28 is configured such that the user needs to physically manipulate the switch to turn it on or off, the switch should be located so as to be accessible to the user. If the switch is configured such that the switch can be actuated without physical manipulation by the user, the switch can be positioned so that it is not readily physically manipulated by the user. For example, the switch 28 can be located on the top surface 40 or on the bottom surface 42. In addition, the switch 28 can be located on, under or embedded within the nail platform 6, the EL film 20 or the protective layer 38.

The optional resistor 26 can be included in the electric circuit 34 to load or balance the EL film in the electric circuit 34. If used, a suitable resistor 26 can have a resistance value that is in a range from about 100 to 300Ω. In one embodiment, the resistor 26 has a resistance value of about 100Ω. The resistor 26 can be located on the top surface 40, on the bottom surface 42, or located on, under or embedded within the thickness of the nail platform 6, the EL film 20 or the protective layer 38.

The electric connectors 36 can be, for example, crimp connectors that electrically connect the EL film 20, the driver module 2, and the other components together. An example of a suitable electric connector is a Crimp Flex® Connector from NICOMATIC SA of Bones-en-Chablais, France. Alternatively, the connectors 36 can be foil conductors. An example of a suitable foil conductor is a CHO-FOIL® &

CHO-FAB™ Shielding Tape from Parker Hannifin Corp. of Woburn, Mass., United States. Alternatively, the connectors 36 can be conductive glue.

Figure 7:
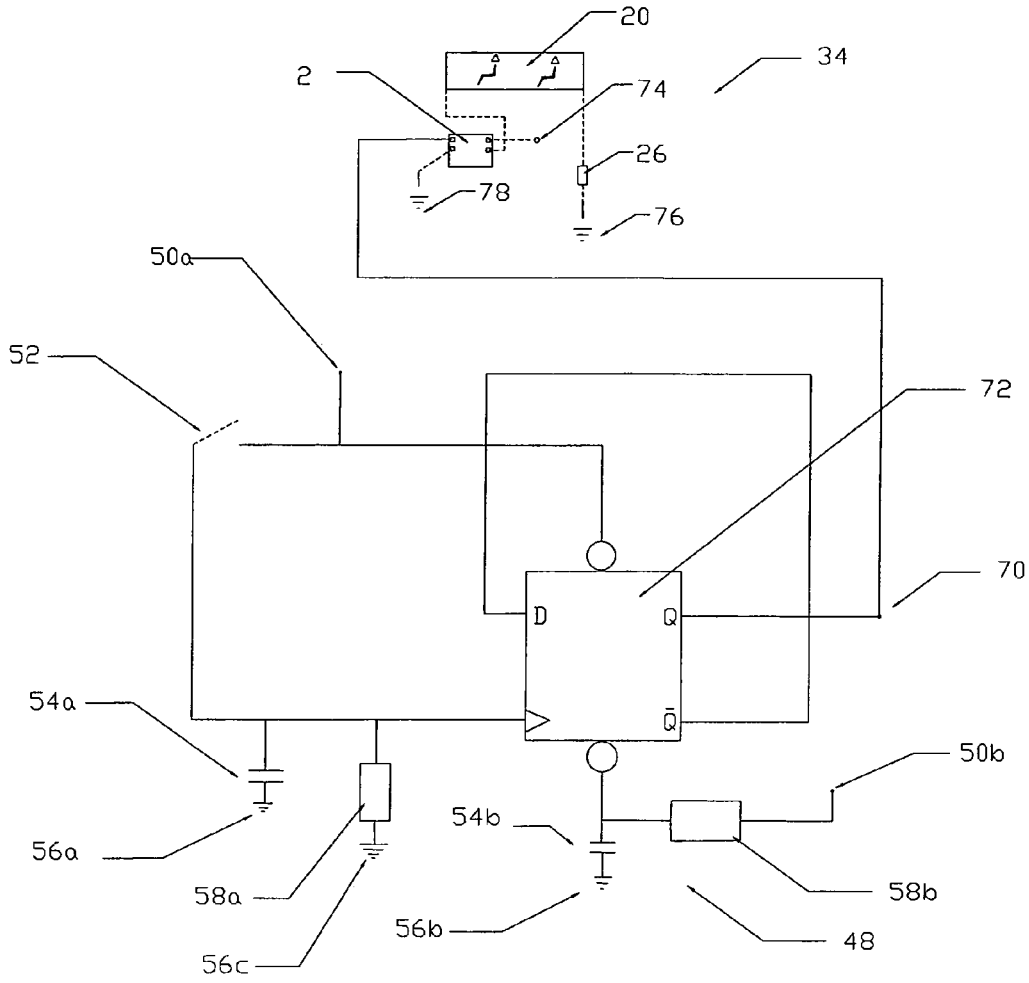
FIG. 7 is a schematically simplified representation of an exemplary embodiment of a D-type flip-flop circuit that is electrically connected to the circuit in FIG. 6 and is used to switch on and off the circuit in FIG. 6.

In another embodiment as shown in FIG. 7, a D-type flip-flop circuit 48 is connected to the electric circuit 34 in FIG. 6 allowing the user to turn on and off the EL film 20. The D-type flip-flop circuit 48 holds an output voltage value hi or low until as switch is turned on or off. The D-type flip-flop circuit 48 can include a momentary contact switch 52, D-Type flip flop chip 72, a first resistor 58*a*, a second resistor 58*b*, a first capacitor 54*a*, a second capacitor 54*b*, and electric connectors for connecting the components of the circuit to each other. The capacitors 54*a*, 54*b* and resistor 58*a* are connected to ground 56*a*, 56*b*, 56*c*. Also the switch is connected to the electric circuit 34 through a first input end 50*a*, a second input end 50*b*, and an output end 70.

The output end 70 is connected to the driver module 2 of the circuit 34. The driver module 2 is "on" when the output voltage value is "low", and is "off" when the voltage value is "hi". Power source 74 provides power, and the resistor 26 and driver module 2 are grounded 76, 78.

The chip 72 is the functional part of the D-type flip-flop switch. An example of a suitable chip 72 is a NC7SP74 TinyLogic® ULP D-Type Flip-Flop with present and clear from Fairchild Semiconductor Corporation of South Portland, Me., United States. Other latching devices that operate on the similar basic principle of the D-type flip-flop circuit can also be used as a substitute for the circuit 48.

In an embodiment, the input ends 50*a* and 50*b* can be connected to a 3 volt DC power source. The first resistor 58*a* can have a resistance value of 10KΩ; the second resistor 58*b* can have a resistance value 100KΩ. The capacitors 54*a* and 54*b* are used to filter signals. Each of them can have a capacitance value of 0.1 μF.

The optional protective layer 38 is a layer that when used protects the EL film 20 from degradation. The protective layer 38 can be made of any substance that is suitable for protecting the EL film 20, for example acrylic. The protective layer 38 preferably covers the EL film 20. If the EL film does not cover the entire nail platform, the protective layer 38 can nonetheless cover the entire nail platform or just the EL film. The layer 38 is preferably generally transparent to avoid degrading the brightness of the light from the El film. The layer 38 can also be translucent.

When one or more of the components of the electrical circuit are exposed on the bottom surface of the nail platform, a protective cover or layer (not shown) can also be provided on the bottom surface 32 to water proof the electrical components.

As shown in FIGS. 2 and 3, the driver module 2 and holder 4 (and battery 3) are positioned on the bottom surface 32 of the nail platform 6. Alternatively, the driver module 2 and/or battery 3 can be placed on the top surface 30 of the nail platform 6, embedded wholly or partially in the thickness 18 of the nail platform 6, embedded wholly or partially in the thickness of the protective layer 38, or disposed on the top surface 40 of the nail 1.

Figure 4:
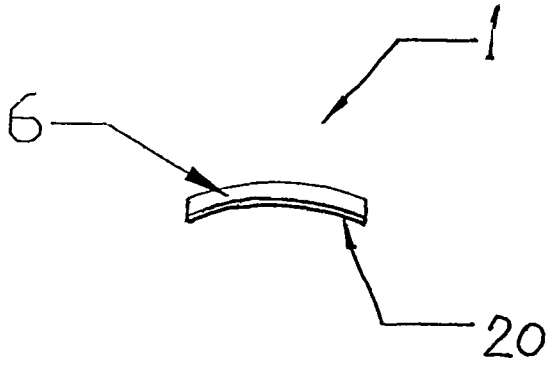
FIG. 4 is a cross-sectional view similar to FIG. 2 of an embodiment including an electroluminescent film on a bottom surface of a nail platform.
Figure 5:
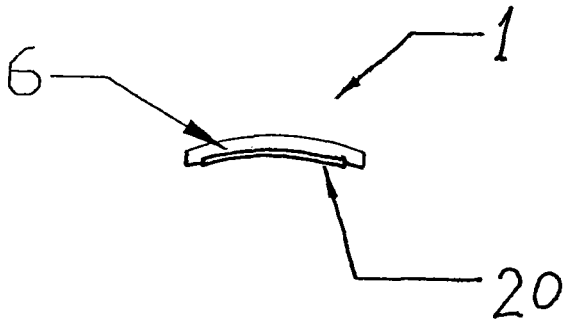
FIG. 5 is a cross-sectional view similar to FIG. 2 of an embodiment including an electroluminescent film embedded in the thickness of a nail platform.

In another embodiment as shown in FIG. 4, the EL film 20 can be attached to the bottom surface 32 of the nail platform 6. In this case, the protective layer 38 need not be used, unless protection of the top surface of the nail platform is desired. Alternatively, the EL film 20 can be embedded at least partially in the thickness 18 of the nail platform 6, as shown in FIG. 5. Again, the protective layer 38 is optional in this embodiment. The EL film is shown as being partially embedded in FIG. 5, but the film 20 could be wholly embedded so that the film is entirely disposed between the top and bottom surfaces 30, 32 of the nail platform 6. Moreover, the EL film 20 could be embedded such that the top surface of the EL film is coextensive with the top surface of the nail platform (i.e. the top surface of the EL film forms a portion of the top surface of the nail platform) and/or a bottom surface of the EL film is coextensive with the bottom surface of the nail platform (i.e. the bottom surface of the EL film forms a portion of the bottom surface of the nail platform).

Figure 8:
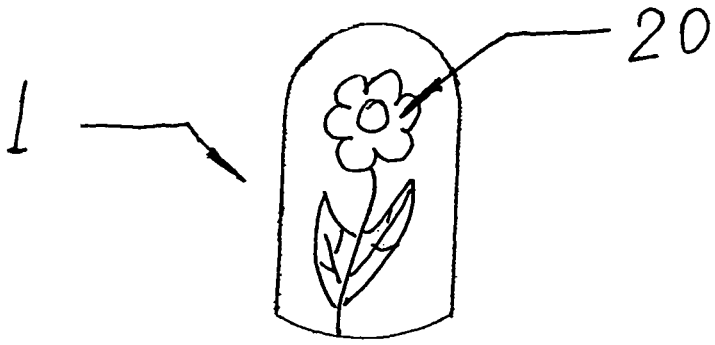
FIG. 8 is a top view of an embodiment including an electroluminescent film on a top surface of a nail platform, wherein the electroluminescent film is in a form of a flower design.

Referring to FIG. 8, a top view of the artificial nail 1 is shown as including an EL film 20 in the shape of a flower that is located on at least a portion of the top surface 30 of the nail platform 6. The film 20 can be made in multiple colors and take the form of an infinite number of designs. Alternatively, the EL film can have a masking material disposed thereon. For example, the masking material can be in the design of a flower (or any other design), in which case the EL film serves to backlight the design formed by the masking material.

Figure 9:
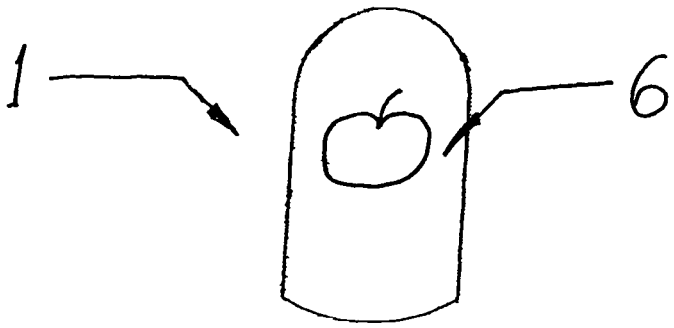
FIG. 9 is a top view of an embodiment including an electroluminescent film on a top surface of a nail platform, where a design is applied to the electroluminescent film.

Referring to FIG. 9, a top view of the artificial nail 1 is shown where an EL film is located on at least a portion of the bottom surface 32 of the nail platform 6, or embedded within the thickness of the nail platform, and a design is painted or otherwise formed on the top surface of the nail platform 6. For example, an apple can be painted on the top surface of the nail platform using nail polish. In this embodiment, when the EL film is illuminated, the light from the film backlights the apple or other design.

The invention claimed is:

1. An artificial nail, comprising:

a nail platform having a top surface, a bottom surface, and a thickness defined between the top surface and the bottom surface;

electroluminescence material connected to the nail platform; and an electric circuit electrically connected to the electroluminescence material, the electric circuit including a driver module disposed on the nail platform providing alternating current to the electroluminescence material, and the driver module is disposed above or below the electroluminescence material.

2. An artificial nail according to claim 1, wherein the electroluminescence material is disposed on the top surface of the nail, and the electroluminescence material covers the entire area of the top surface.

3. An artificial nail according to claim 1, wherein the electroluminescence material is embedded in the thickness of the nail platform.

4. An artificial nail according to claim 1, wherein le nail is configured as an artificial fingernail or an artificial toenail.

5. An artificial nail according to claim 1, wherein the electroluminescence material is an electroluminescent film.

6. An artificial nail according to claim 5, comprising a masking material disposed on the electroluminescent film.

7. An artificial nail according to claim 1, wherein the electroluminescence material is disposed on the top surface of the nail platform and further comprising electroluminescence material on the bottom surface of the nail platform.

8. An artificial nail according to claim 1, further comprising a light emitting diode connected to the nail platform.

9. A nail decorating product, comprising:

a nail platform having a first major surface, a second major surface generally opposed to the first major surface, and a thickness defined between the first and second major surfaces:

an electroluminescence material connected to the nail platform;

an electric circuit electrically connected to the electroluminescence material, the electric circuit including a driver module on the nail platform that converts direct current into alternating current the driver module is disposed above or below the electroluminescence material, a direct current power source, and a switch that controls the flow of current to the electroluminescence material,

10. A nail decorating product according to claim 9, wherein the power source is replaceable.

11. A nail decorating product according to claim 9, wherein the power source is rechargeable.

12. A nail decorating product according to claim 9, wherein the power source is a battery.

13. A nail decorating product according to claim 9, wherein the switch. is at least one of a light emitting diode-type switch, a leaf-type switch, a magnet switch, or a mercury switch.

14. A nail decorating product according to claim 9, wherein the nail is configured as an artificial fingernail or an artificial toenail.

15. A nail decorating product according to claim 9, wherein the electroluminescence material is an electroluminescent film, and further comprising a protective layer over the electroluminescent film.

16. The nail decorating product of claim 9, wherein the electroluminescence material is disposed on the first major surface which is a top surface of the nail platform, and the electroluminescence material covers the entire area of the top surface.

* * * * *